US006550112B2

(12) United States Patent
Röhrle et al.

(10) Patent No.: US 6,550,112 B2
(45) Date of Patent: Apr. 22, 2003

(54) CLOSURE FOR A SEAT BELT

(75) Inventors: Martin Röhrle, Mutlangen (DE); Bob McFalls, Shelby Township, MI (US)

(73) Assignees: TRW Occupant Restraint Systems GmbH & Co. KG, Alfdorf (DE); TRW Vehicle Safety Systems Inc., Lyndhurst, OH (US)

( * ) Notice: Subject to any disclaimer, the term of this patent is extended or adjusted under 35 U.S.C. 154(b) by 0 days.

(21) Appl. No.: 09/887,186

(22) Filed: Jun. 22, 2001

(65) Prior Publication Data

US 2002/0092141 A1 Jul. 18, 2002

(30) Foreign Application Priority Data

Jan. 18, 2001 (DE) ..... 201 00 932 U

(51) Int. Cl.[7] ..... A44B 11/26
(52) U.S. Cl. ..... 24/641; 24/633
(58) Field of Search ..... 24/633–642

(56) References Cited

U.S. PATENT DOCUMENTS

| | | | | | |
|---|---|---|---|---|---|
| 4,733,443 | A | * | 3/1988 | Tolfsen | 24/637 |
| 4,928,366 | A | * | 5/1990 | Ballet | 24/636 |
| 5,008,989 | A | * | 4/1991 | Wedler et al. | 24/633 |
| 5,195,224 | A | * | 3/1993 | Bock et al. | 24/633 |
| 5,210,915 | A | * | 5/1993 | Clarke | 24/641 |
| 5,555,609 | A | * | 9/1996 | Tolfsen et al. | 24/633 |
| 5,566,431 | A | * | 10/1996 | Haglund | 24/633 |
| 5,595,400 | A | * | 1/1997 | Wier | 24/633 |
| 5,765,266 | A | * | 6/1998 | Betz | 24/633 |
| 6,367,129 | B1 | * | 4/2002 | Mori | 24/171 |

FOREIGN PATENT DOCUMENTS

| | | | |
|---|---|---|---|
| DE | 3837376 | A1 | 5/1990 |
| DE | 9202527 | U1 | 5/1992 |
| DE | 4427011 | A1 | 1/1996 |
| DE | 20010538 | U1 | 11/2000 |
| EP | 0341839 | A1 | 11/1989 |
| EP | 1018307 | A1 | 7/2000 |
| GB | 2328244 | A | 2/1999 |
| JP | 11-266907 | * | 10/1999 |

* cited by examiner

*Primary Examiner*—James R. Brittain
(74) *Attorney, Agent, or Firm*—Tarolli, Sundheim, Covell & Tummino L.L.P.

(57) ABSTRACT

A closure for a seat belt comprises a release button shiftably mounted on a frame and cooperating with a latch which can be swiveled between a locking position and an opening position around a swiveling axis, and a blocking element that can assume a blocking position in which it blocks the latch in the locking position. The blocking element is mounted on the frame so as to pivot around an axis that passes through a center of gravity of the blocking element, so that it can be swiveled by the release button out of the blocking position into a release position.

9 Claims, 16 Drawing Sheets

CLOSURE FOR A SEAT BELT

The invention relates to a closure for a seat belt having a release button movably mounted on a frame and provided for a latch that can be swiveled between a locking position and an opening position around a swiveling axis, and a blocking element that can assume a blocking position in which it blocks the latch in its locking position.

Such a closure is known, for example, from DE 44 27 011. With this closure, the blocking element is mounted so that it can move in one direction in which the acceleration by a seat belt tensioner also occurs. Therefore, in order to ensure that the closure can withstand the tensioner force, a likewise movably mounted locking element is needed which prevents a shifting of the blocking element from its blocking position in the case of high acceleration values. However, in view of the many components used, this arrangement is relatively complex and, because of the components that are movably mounted, namely, the locking member and blocking element, it is failure-prone over the long run.

The objective of the invention is to create a simply structured closure for seat belts that is reliably secured against unintentional opening, even at the high acceleration rates that occur when a seat belt tensioner is activated.

For this purpose, with a closure of the type described above, it is provided that the blocking element is mounted on the frame so as to pivot around an axis that passes through its center of gravity, so that it can be swiveled by the release button out of its blocking position into a release position. Since the blocking element is mounted on its center of gravity, it is not subjected to any torque upon acceleration of the closure, so that it remains in its blocking position and the latch is securely blocked. Moreover, a pivoted component is less failure-prone than a movably mounted component since, with a movably mounted component, the bearing can more easily become dirty over the course of time, thereby leading to greater friction.

Further advantageous embodiments of the invention ensue from the subordinate claims.

Figure 1:
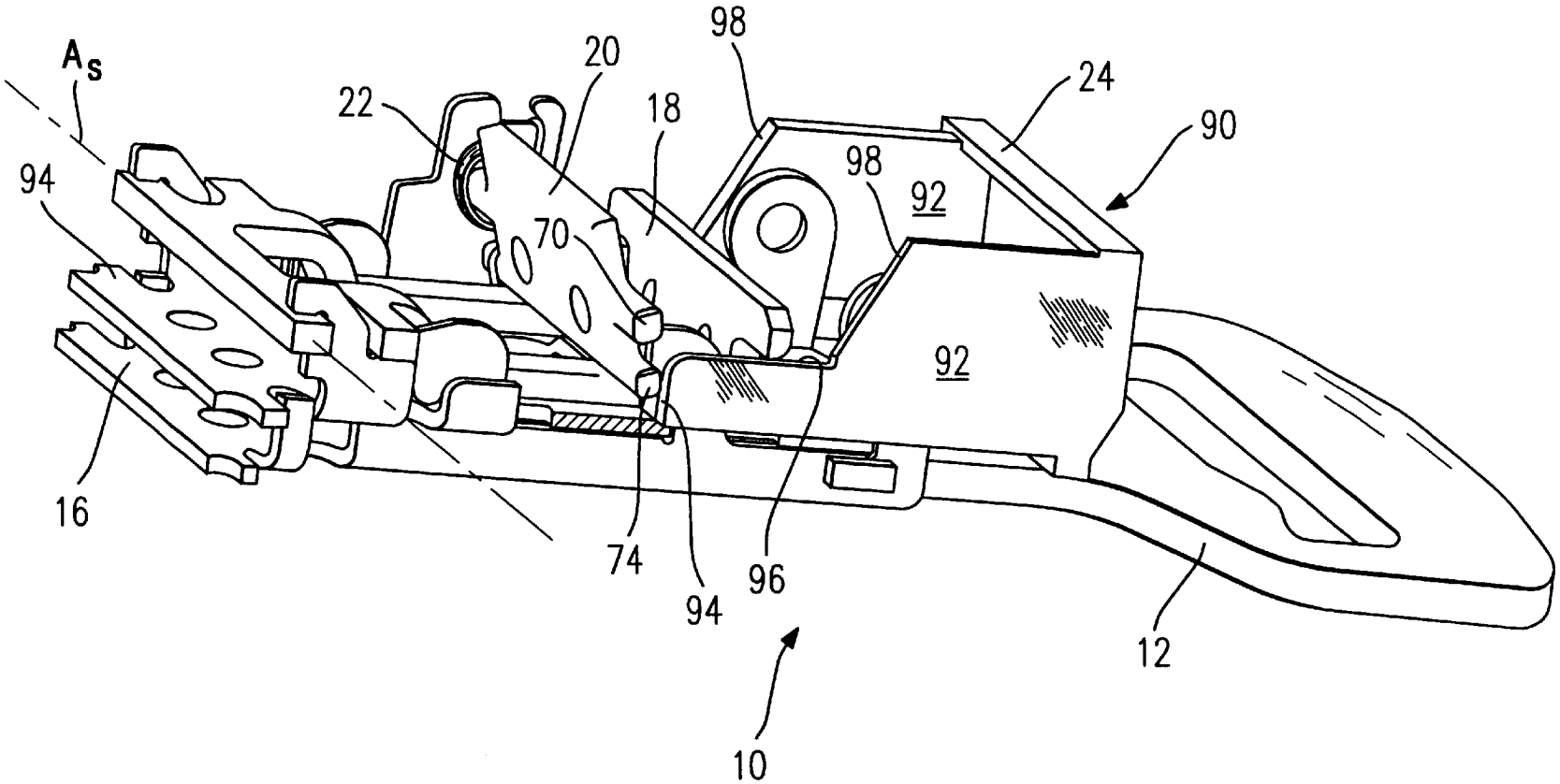
Figure 2:
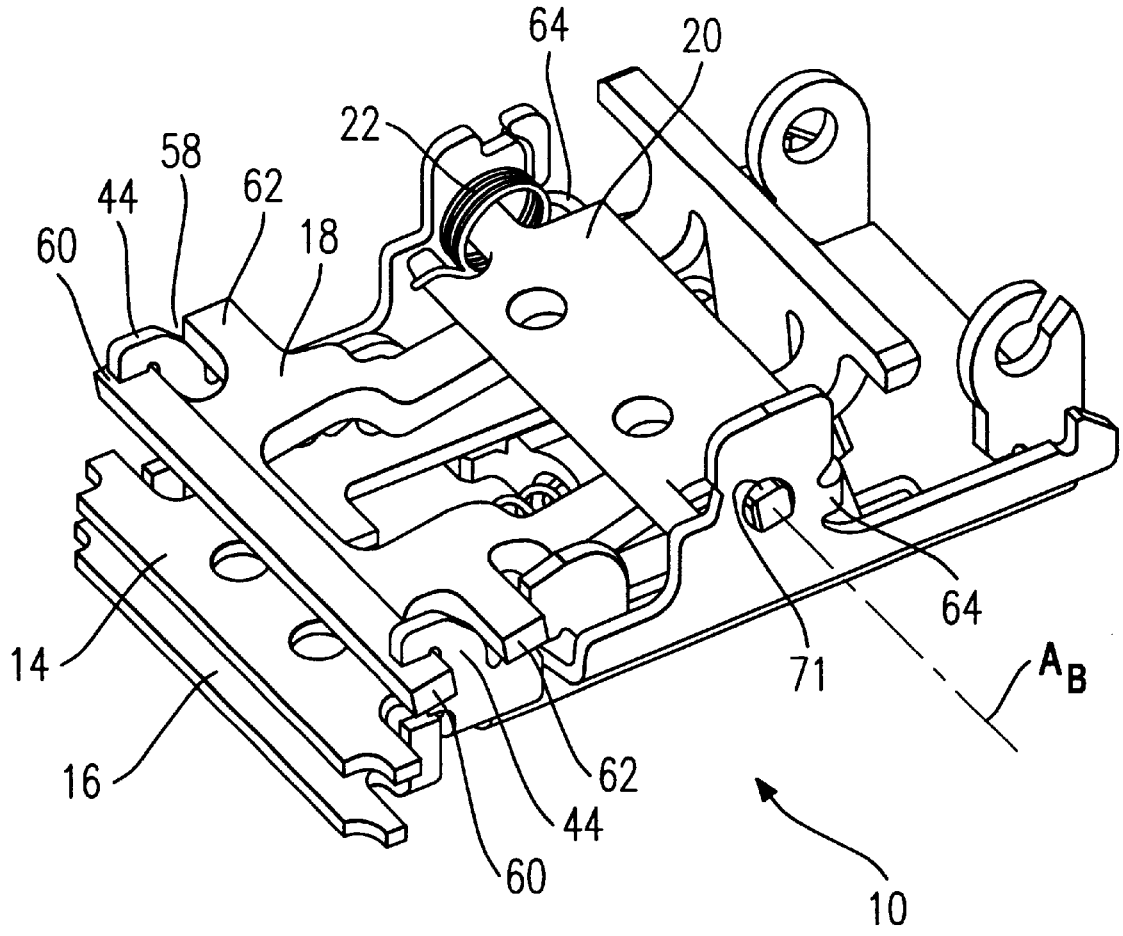
Figure 3:
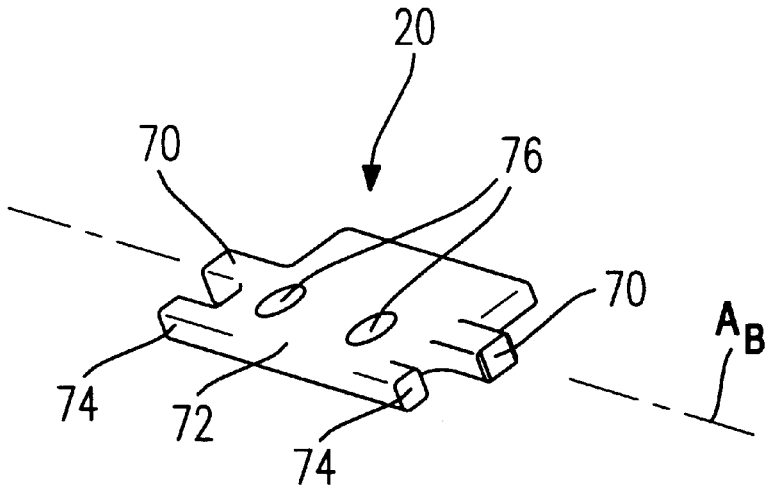
Figure 4:
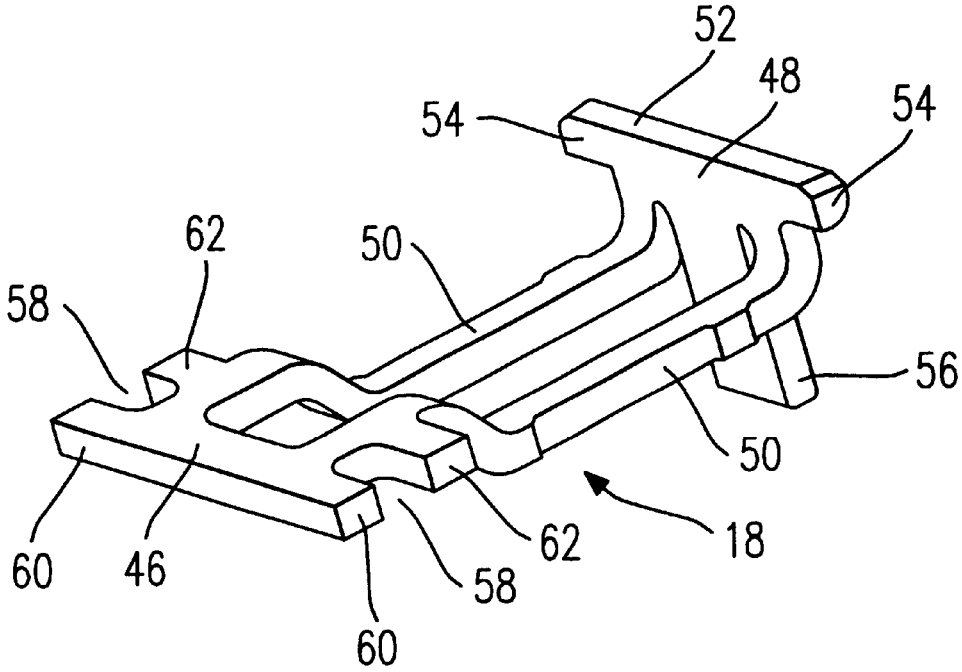
Figure 5:
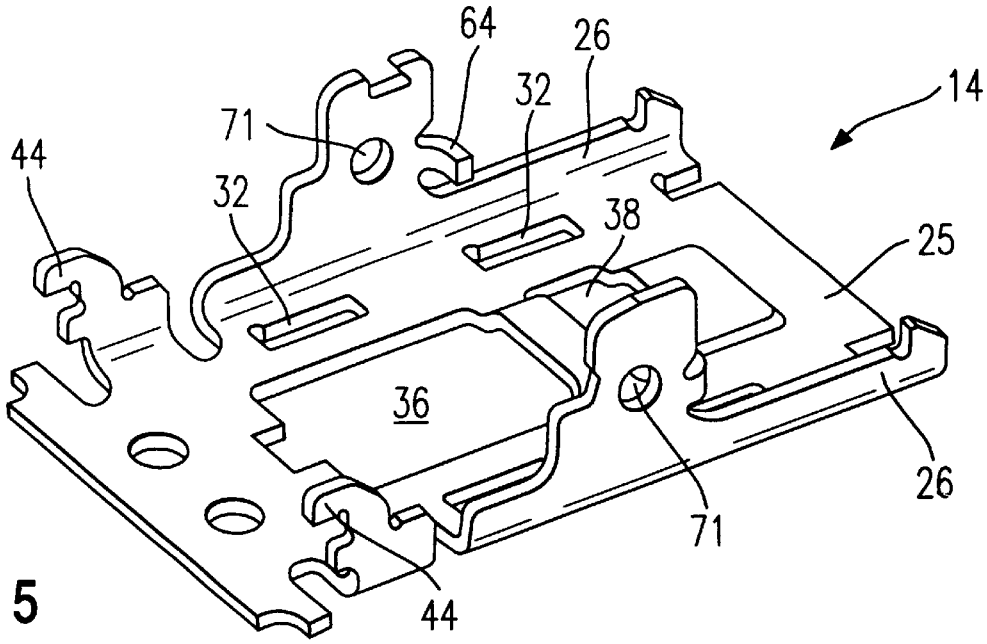
Figure 6:
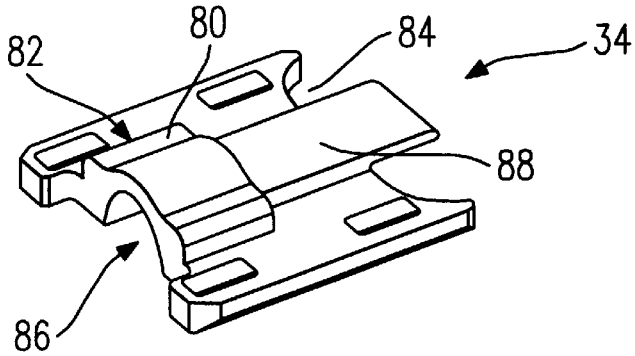
Figure 7:
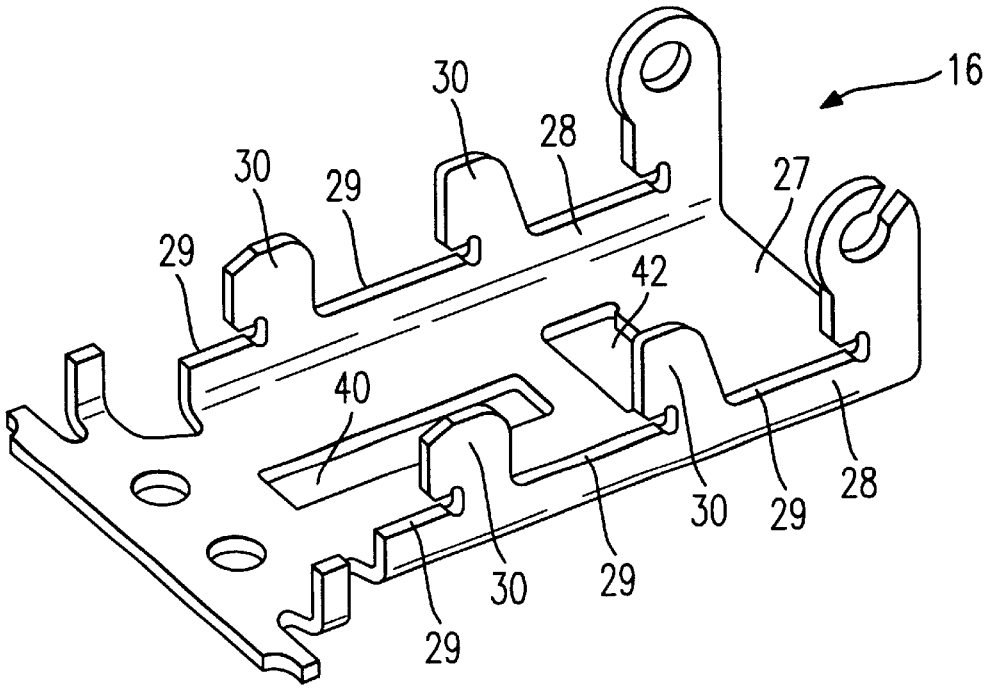
Figure 8:
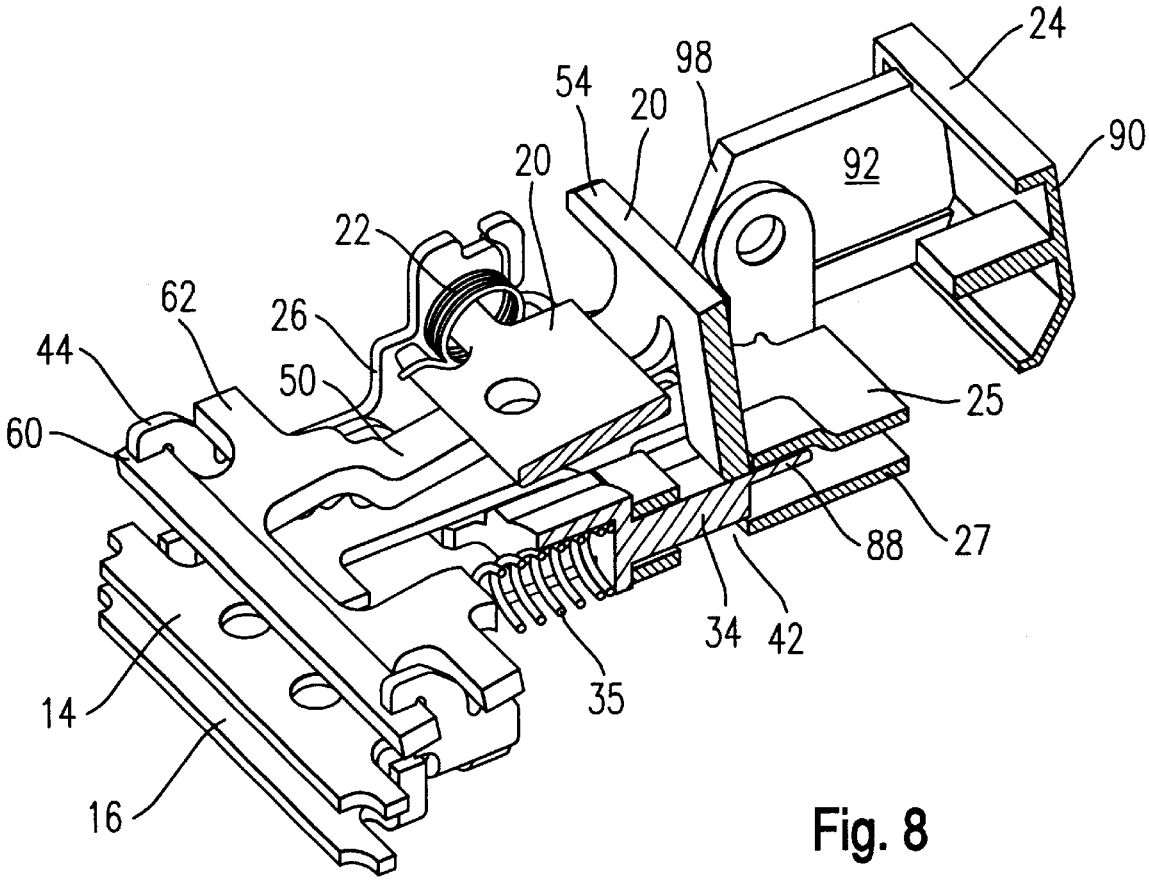
Figure 9:
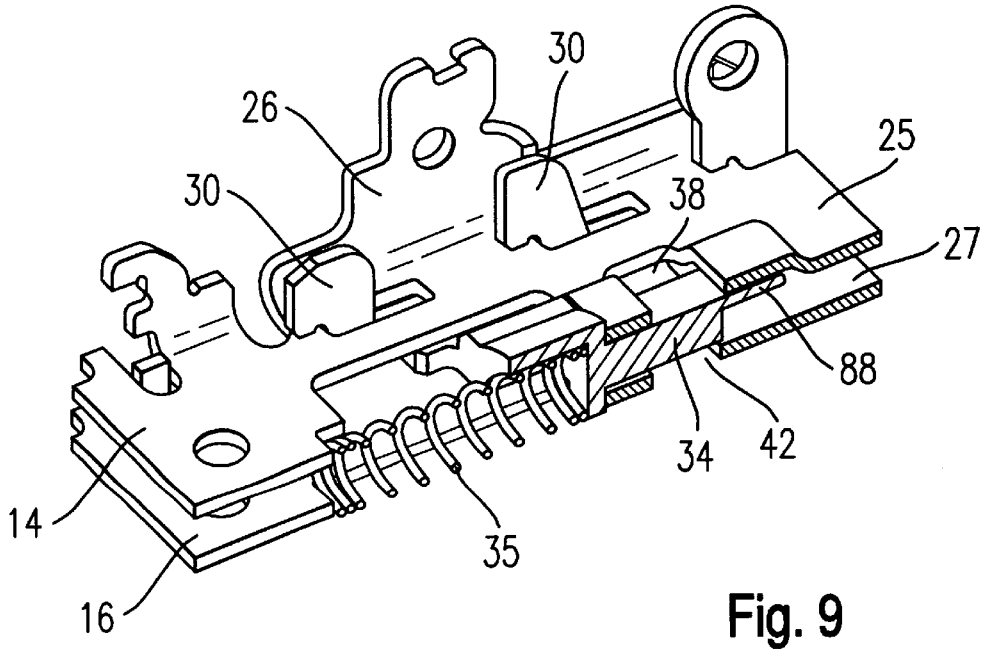
Figure 10:
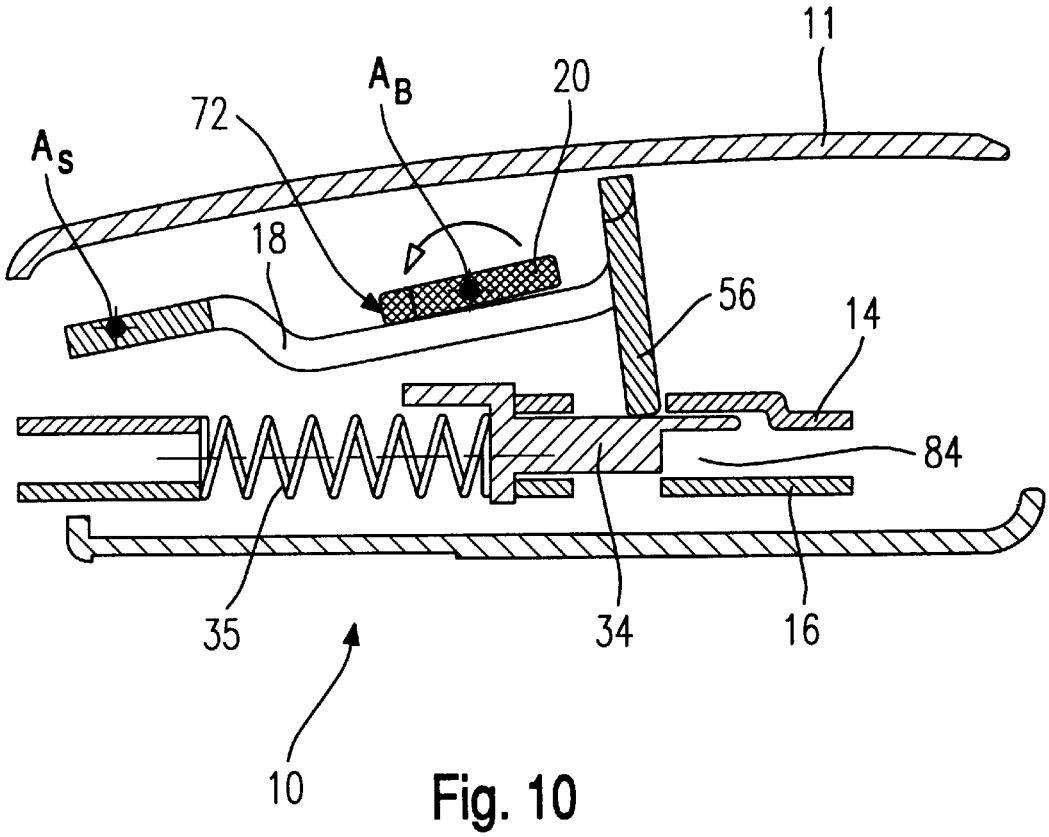
Figure 11:
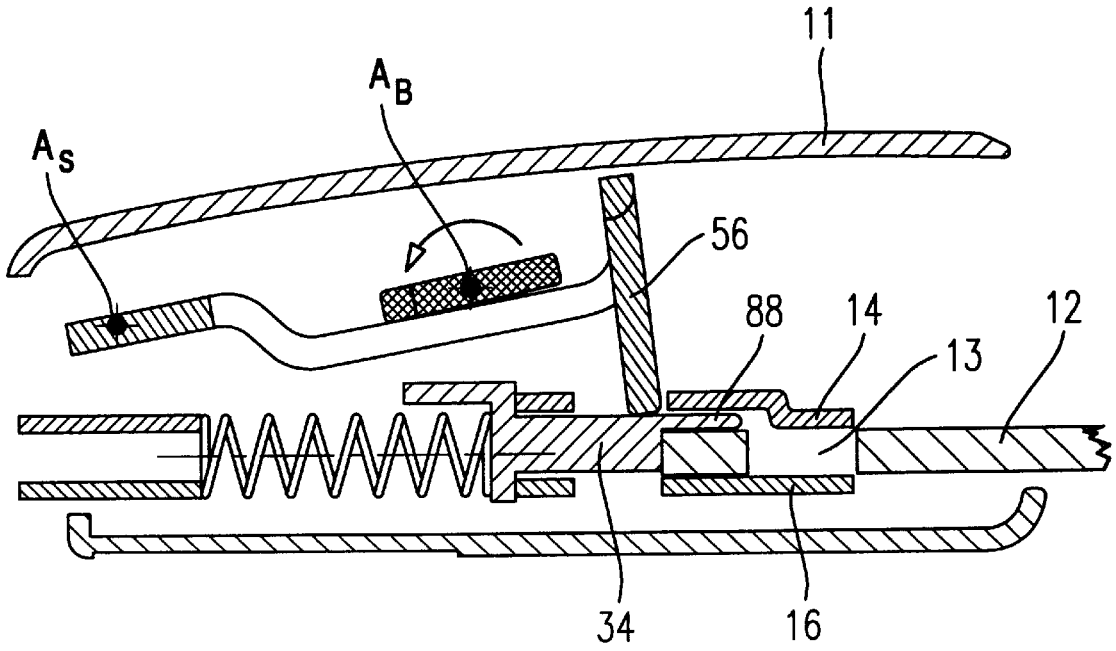
Figure 12:
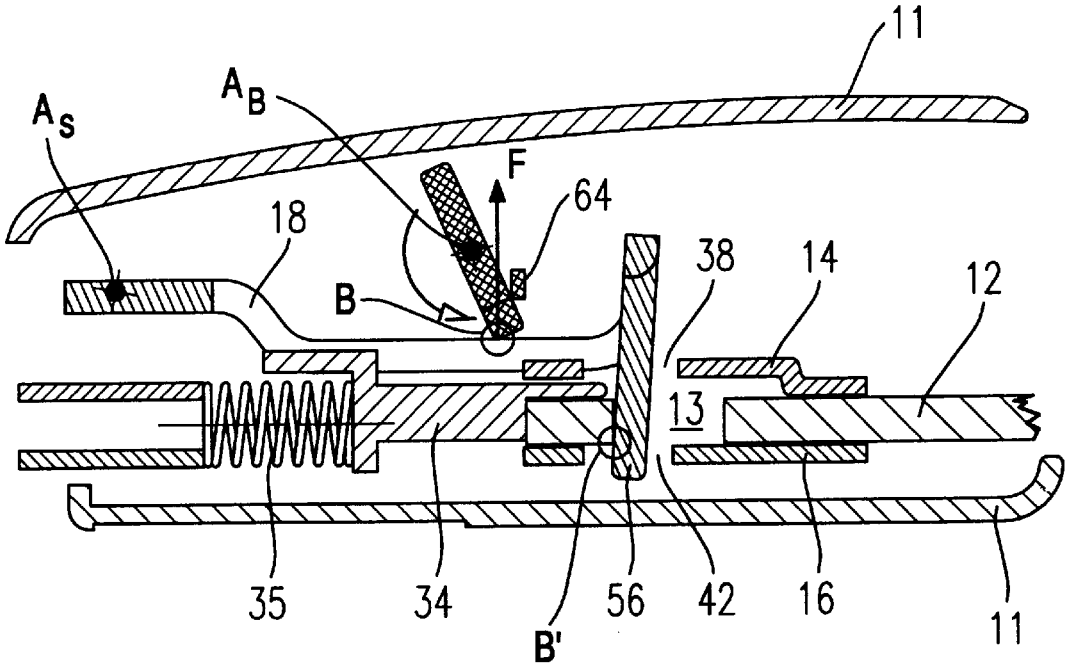
Figure 13:
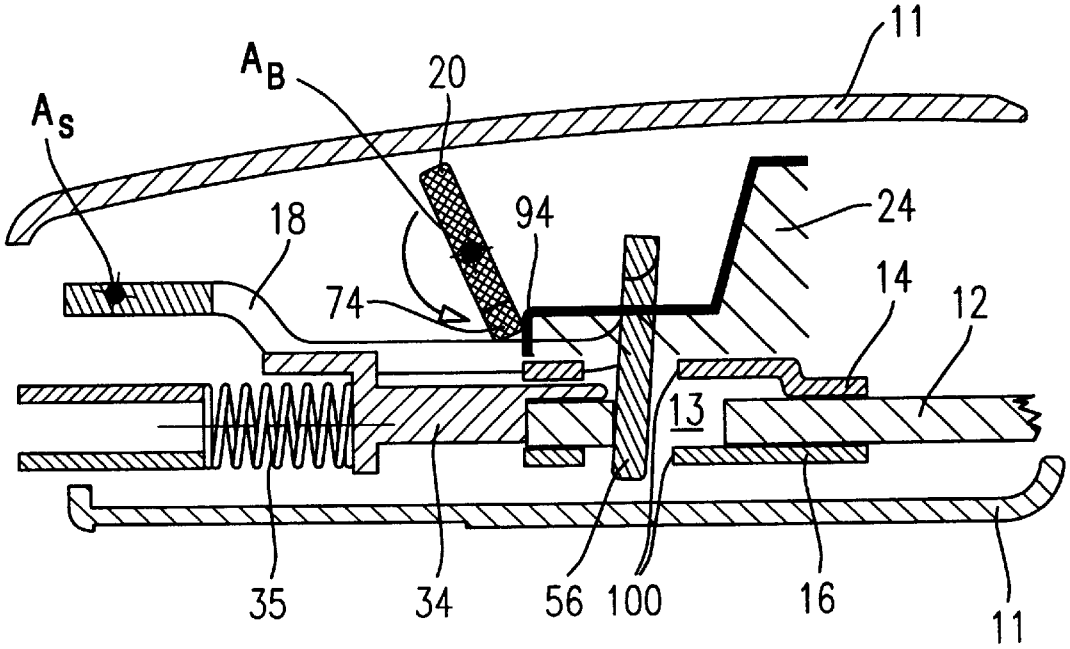
Figure 14:
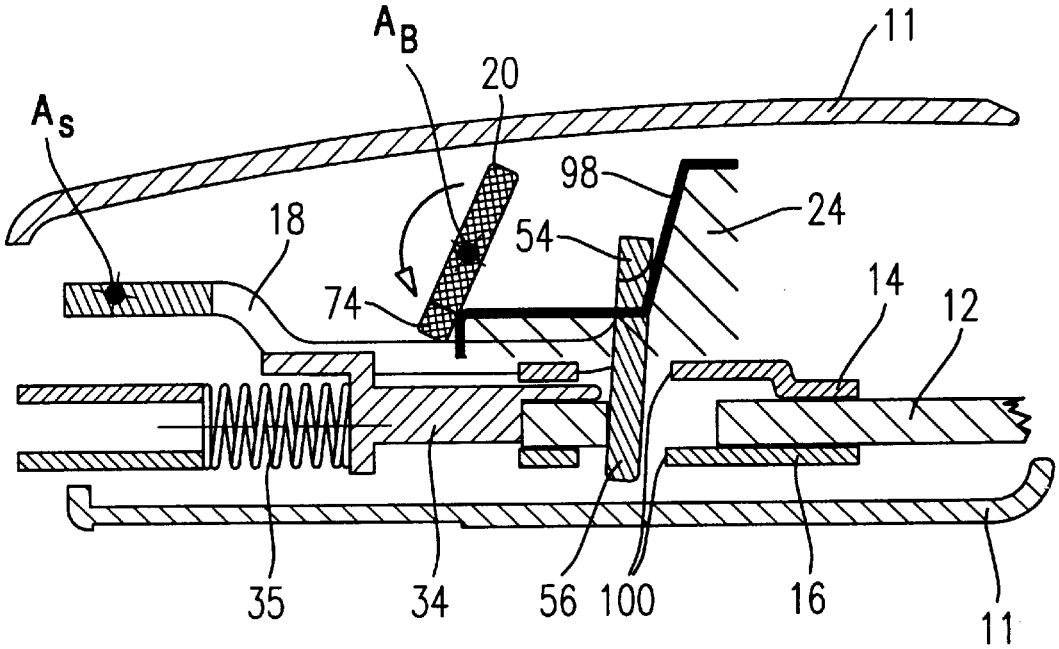
Figure 15:
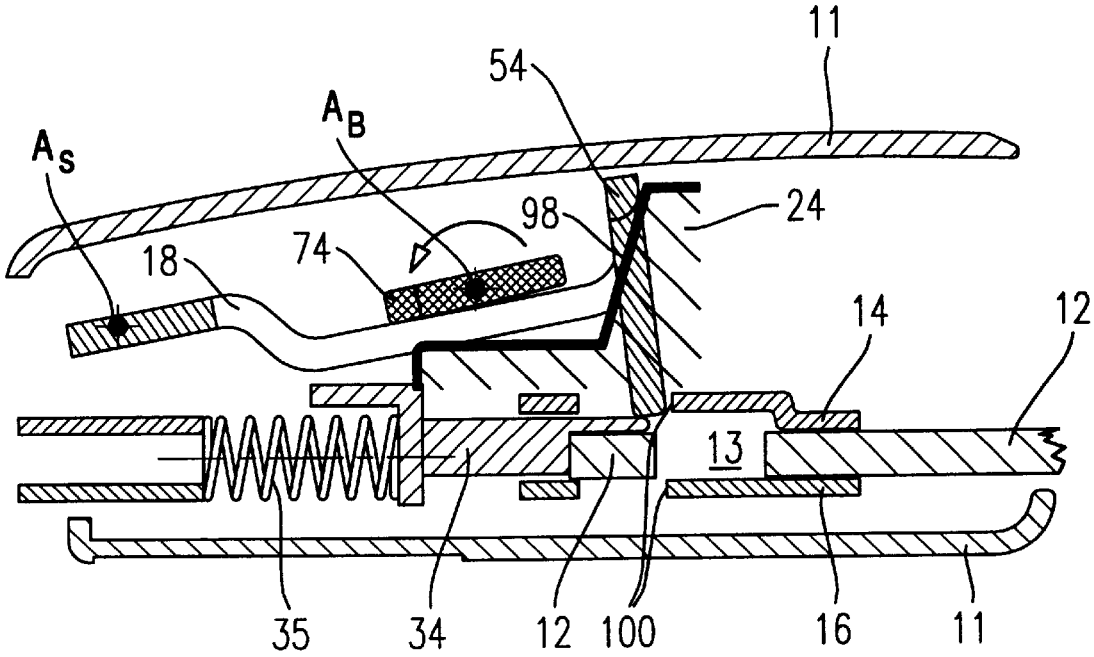
Figure 16:
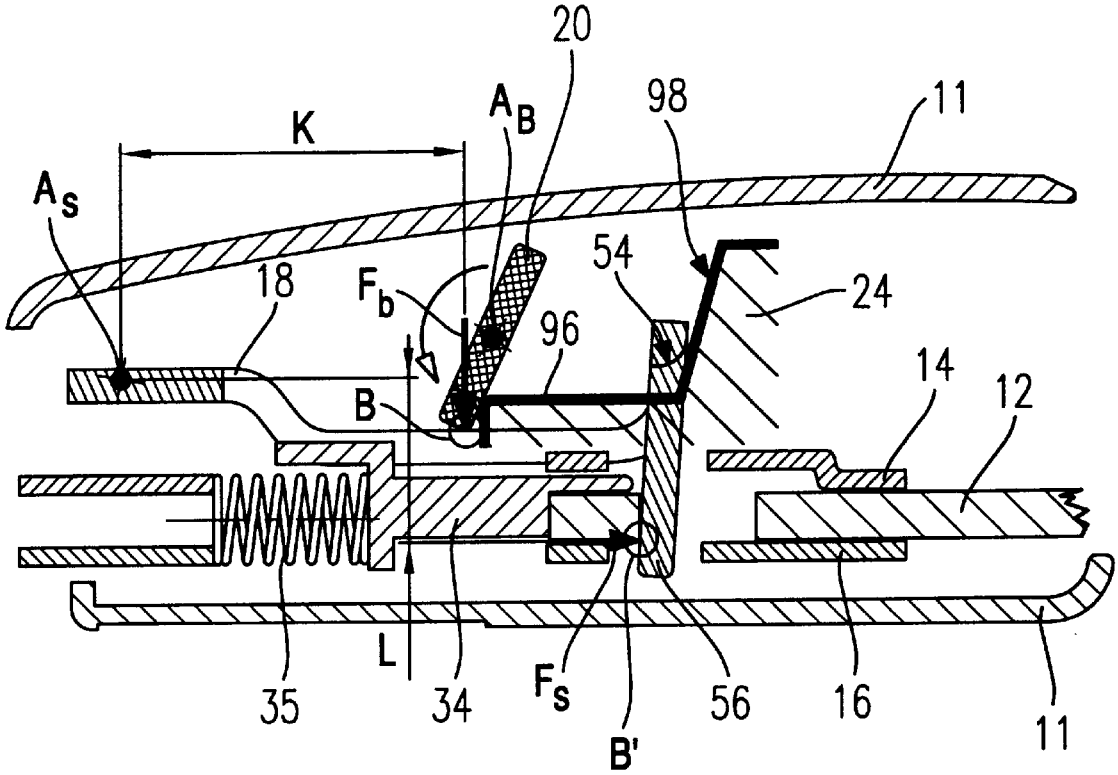
Figure 17:
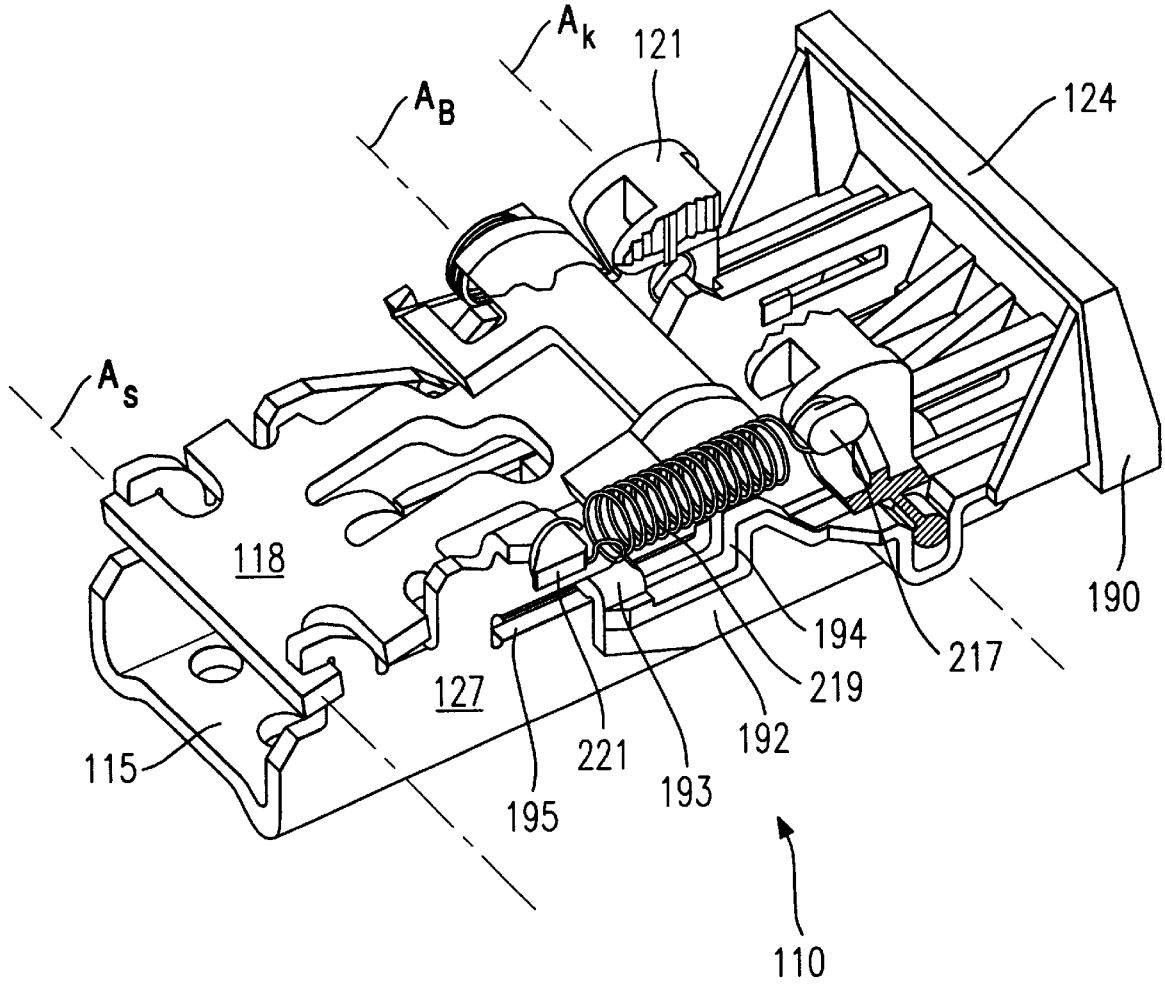
Figure 18:
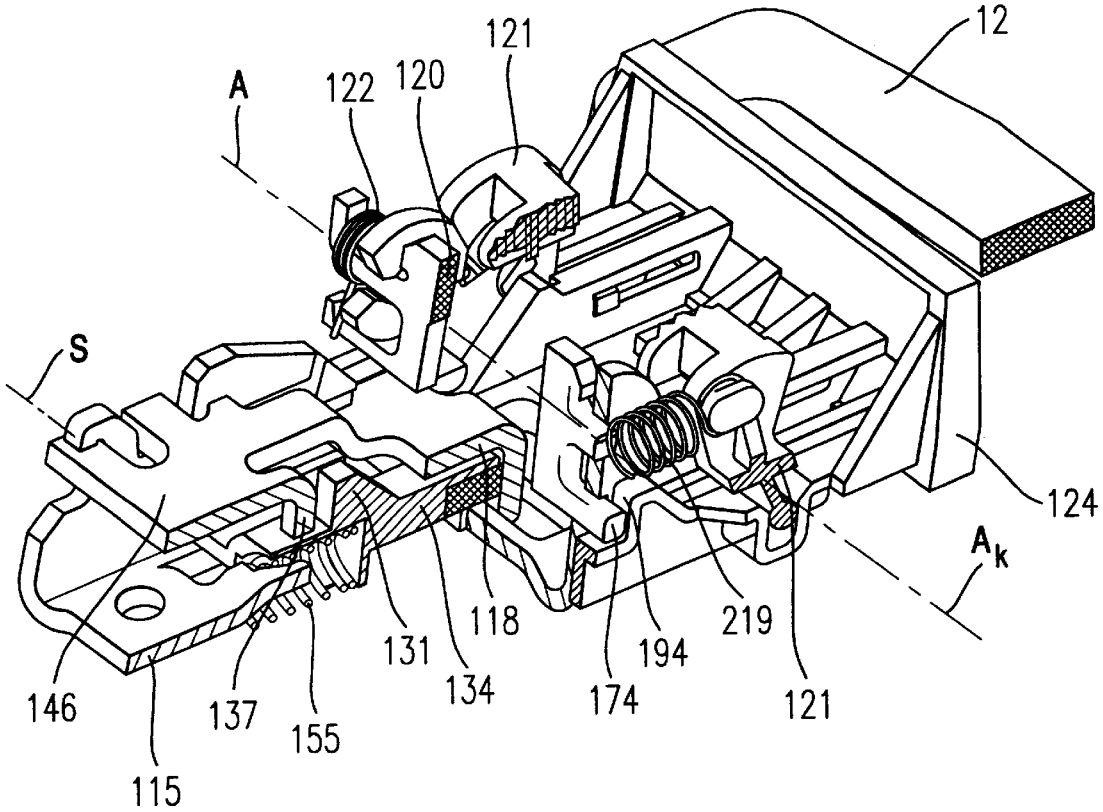
Figure 20:
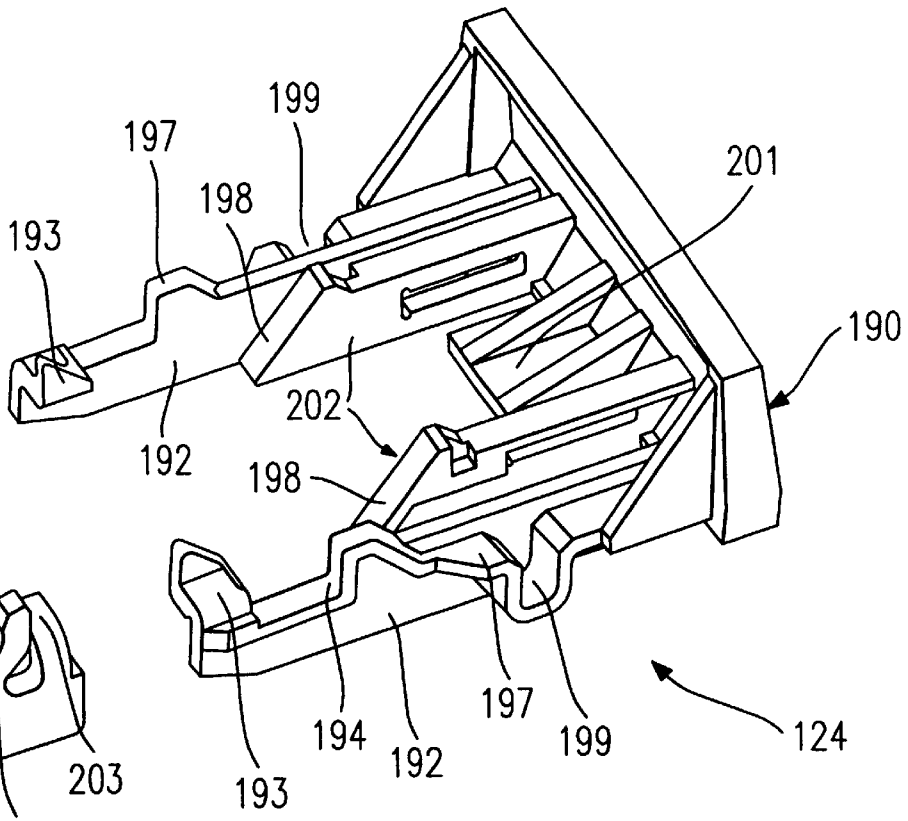
Figure 19:
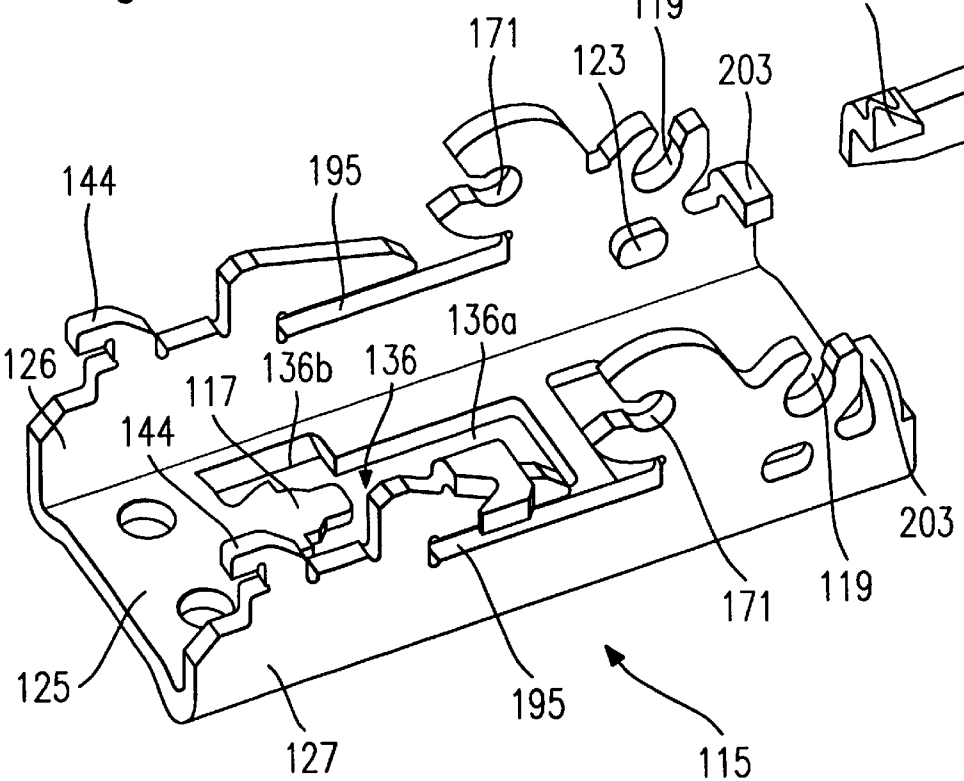
Figure 21:
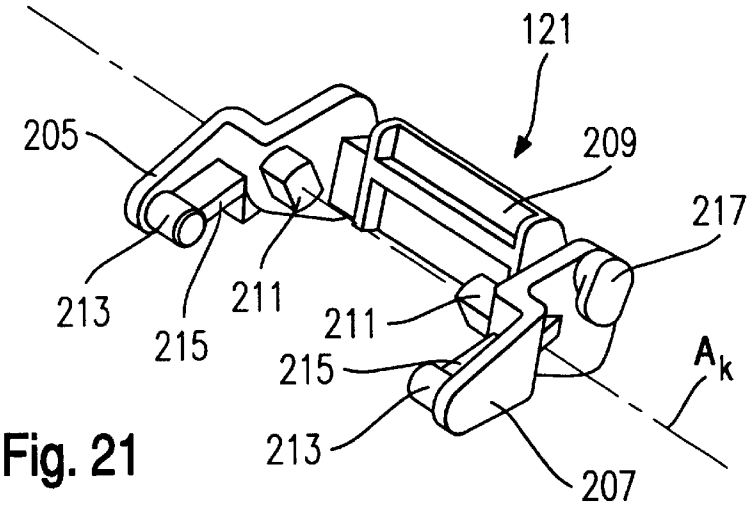
Figure 22:
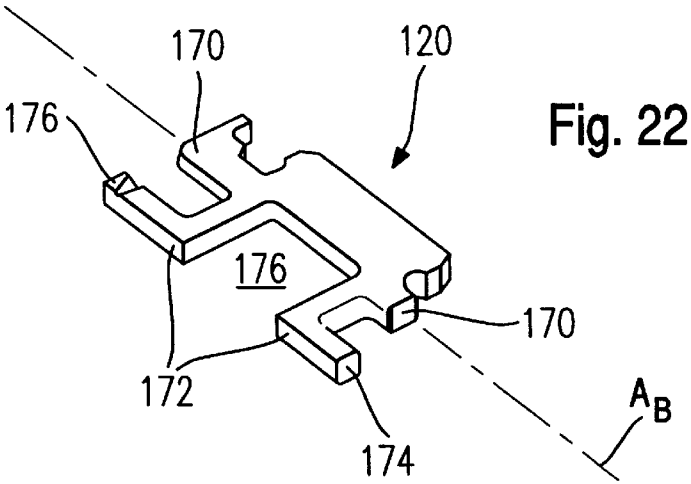
Figure 23:
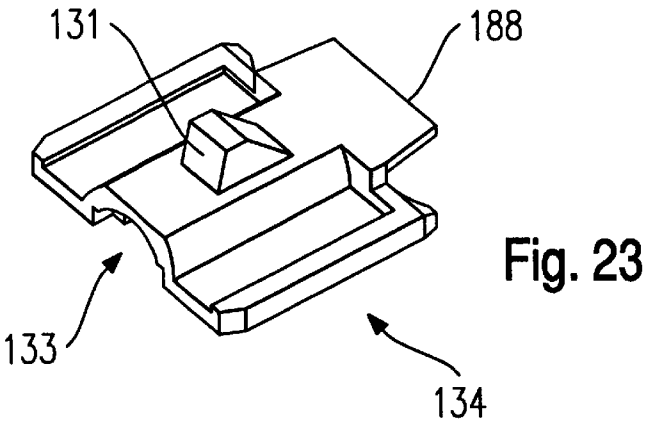
Figure 24:
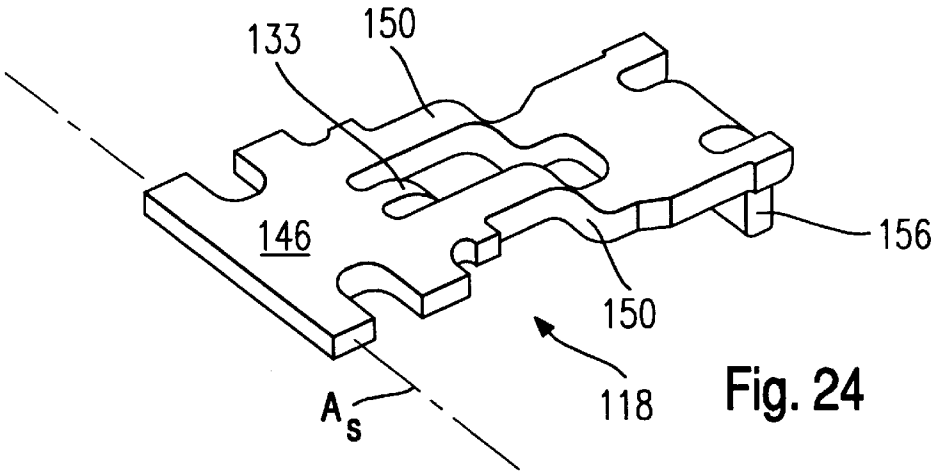
Figure 25:
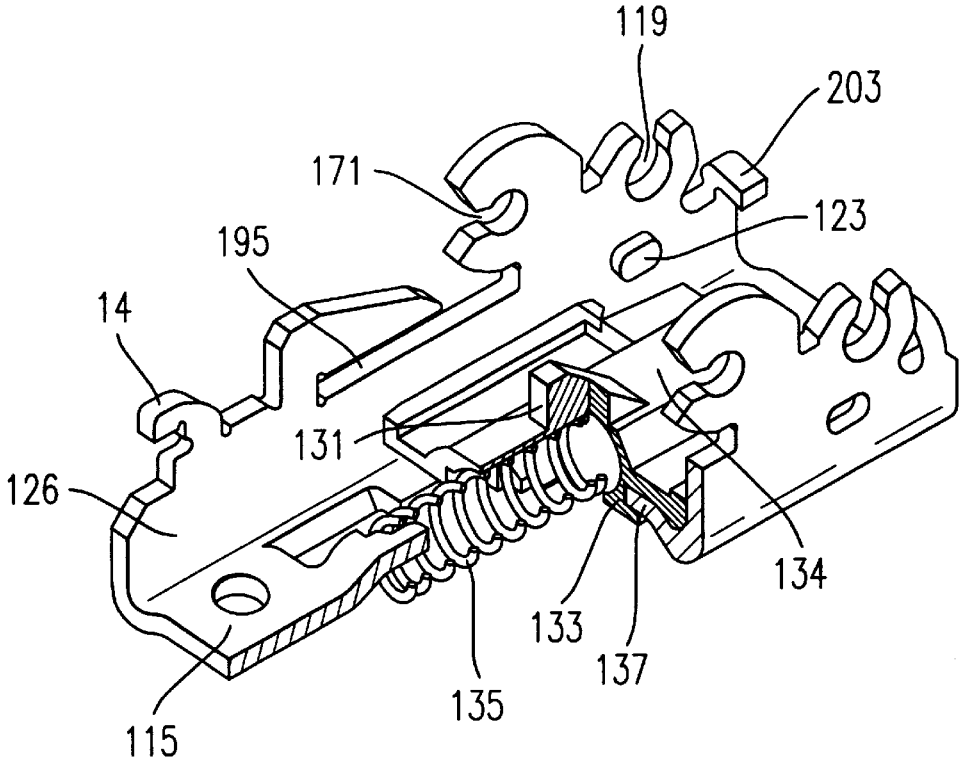
Figure 26:
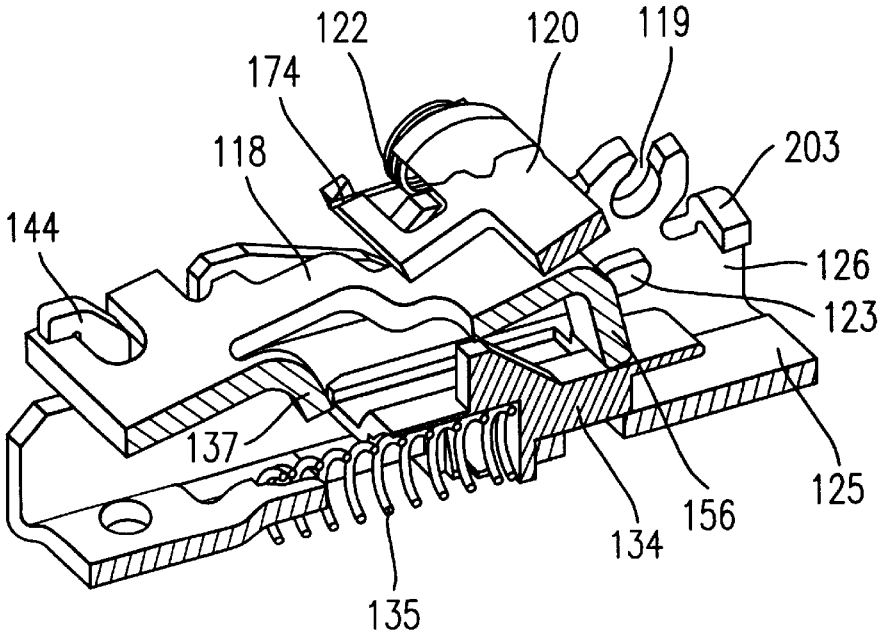
Figure 27:
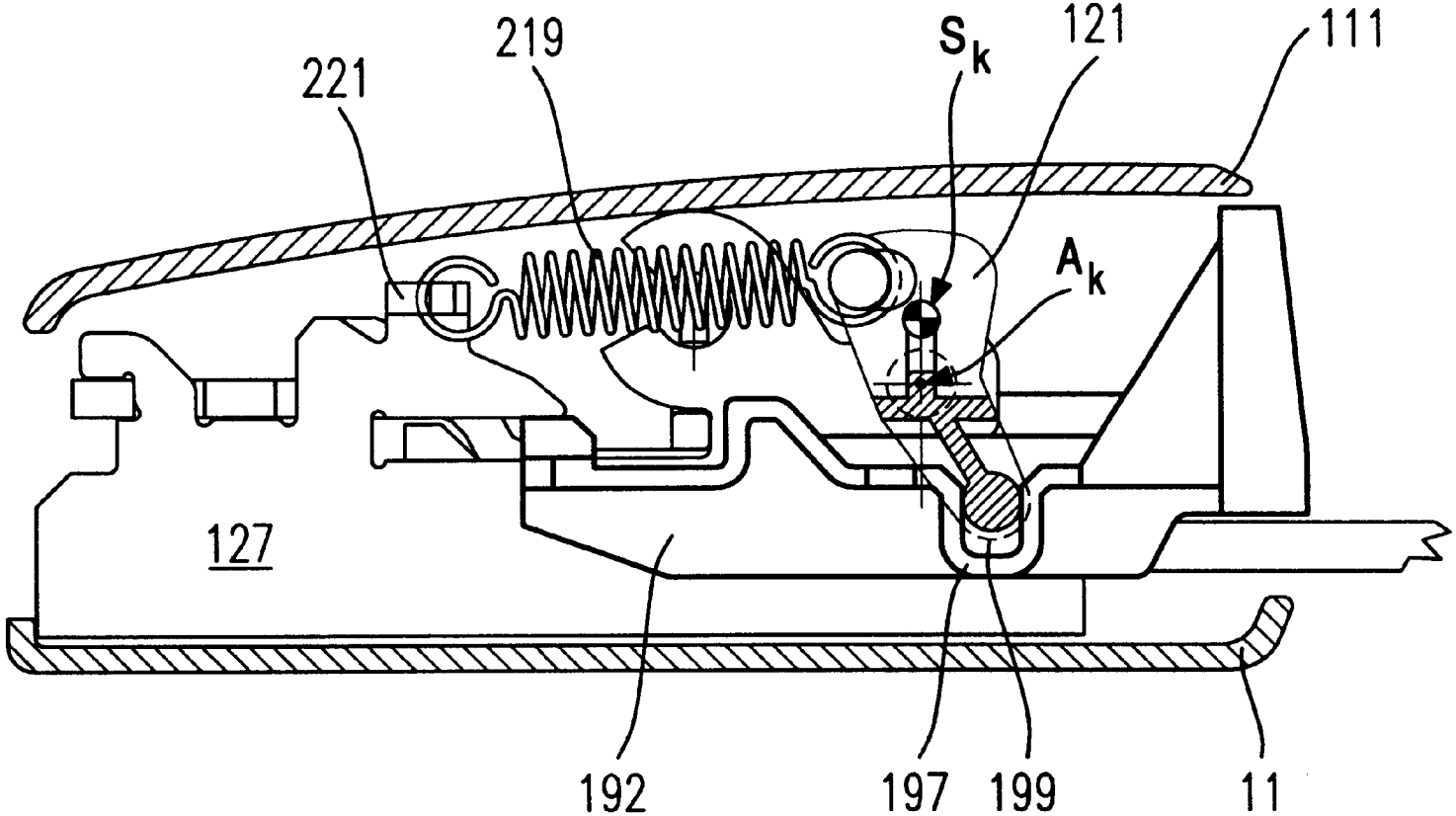
Figure 28:
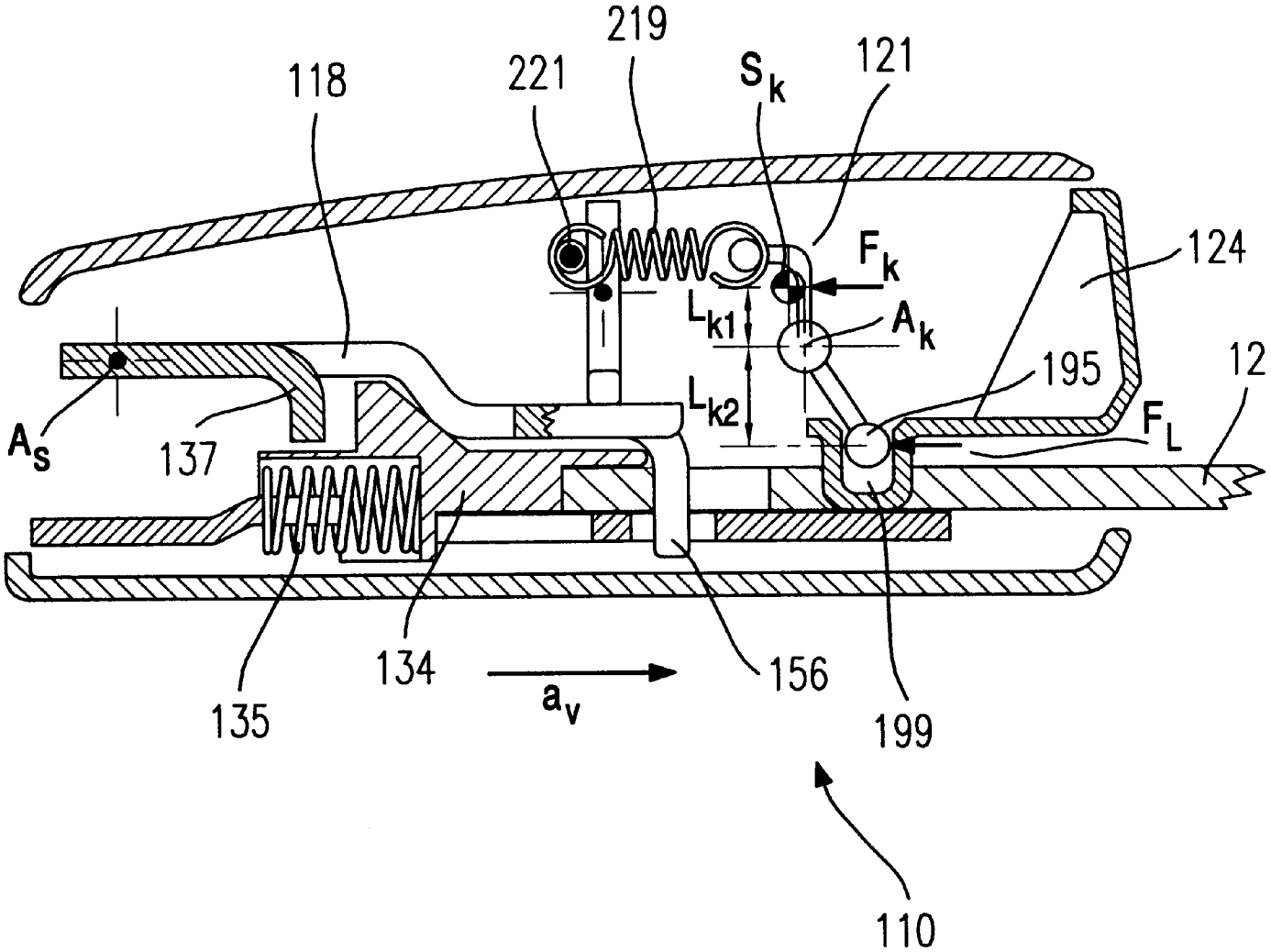

The invention is described below with reference to preferred embodiments. Reference is made to the attached drawings in which the following is shown:

FIG. 1 a perspective view of a closure with an inserted tongue according to a first embodiment of the invention;

FIG. 2 a second perspective view of the closure of FIG. 1;

FIG. 3 a perspective view of a blocking element used in the closure of FIG. 1;

FIG. 4 a perspective view of a latch used in the closure of FIG. 1;

FIG. 5 a perspective view of an upper shell used in the closure of FIG. 1;

FIG. 6 a perspective view of an ejector used in the closure of FIG. 1;

FIG. 7 a perspective view of a lower shelf used in the closure of FIG. 1;

FIG. 8 a perspective view of a cutaway of the closure of FIG. 1;

FIG. 9 a lengthwise section of the closure of FIG. 1;

FIG. 10 a lengthwise section through the closure of FIG. 1 in a basic state;

FIG. 11 a lengthwise section through the closure of FIG. 1 during the insertion of the tongue;

FIG. 12 a lengthwise section through the closure of FIG. 1 with the tongue inserted;

FIG. 13 a lengthwise section through the closure of FIG. 1 with the release button depressed;

FIG. 14 a lengthwise section through the closure of FIG. 1 during the ejection of the tongue;

FIG. 15 a lengthwise section through the closure of FIG. 1 with the tongue released;

FIG. 16 a representation of the force conditions on the closure of FIG. 14;

FIG. 17 a perspective view of a closure with an inserted tongue according to a second embodiment of the invention;

FIG. 18 a perspective view of a cutaway of the closure of FIG. 17;

FIG. 19 a perspective view of a frame used for the closure of FIG. 17;

FIG. 20 a perspective view of a release button used for the closure of FIG. 17;

FIG. 21 a perspective view of a toggle lever used for the closure of FIG. 17;

FIG. 22 a perspective view of a blocking element used for the closure of FIG. 17;

FIG. 23 a perspective view of an ejector used for the closure of FIG. 17;

FIG. 24 a perspective view of a latch used for the closure of FIG. 17;

FIG. 25 a perspective view of a cutaway of the frame and of the ejector of FIGS. 19 and 23;

FIG. 26 a perspective view of a cutaway of the closure of FIG. 17 with the ejected tongue;

FIG. 27 a lengthwise section through the closure of FIG. 17 with the tongue inserted; and FIG. 28 a schematic lengthwise section through the latch of FIG. 17 with indication of the forces and lever arms on the toggle lever.

FIG. 1 shows a closure 10 according to the invention with an inserted tongue 12 and having a frame consisting of an upper shell 14 and of a lower shell 16, a latch 18, a blocking element 20 for the latch 18 and a release button 24 that is movably mounted on the frame. The frame is enclosed by a housing 11 (see FIGS. 10 through 16), which was left out in FIGS. 1 through 9 so that the functional parts can be seen.

The closure 10 has a front end on which the release button 24 is located, and a back end on which the latch 18 is mounted on the upper shell 14 so as to pivot around an axis $A_s$. In the representation of FIG. 1, the latch is in its locking position in the frame, where it latches the conventional tongue 12, which is inserted at the front end of the closure.

The upper shell 14 and the lower shell 16 of the frame are shown individually in FIGS. 5 and 7, and they preferably consist of a U-shaped sheet metal plate with a base 25 or 27 and two parallel legs 26 and 28, which extend perpendicular to the base. The upper shell 14 and the lower shell 16 are connected to each other by means of hook-shaped protrusions 30 on the legs 28 of the lower shell 16, which engage the base 25 of the upper shell 14 through elongated slits 32, the base 25 of the upper shell 14 resting on the edge 29 of the leg 28 of the lower shell 16. As a result, a hollow space is formed between the upper shell 14 and the lower shell 16 into which the tongue 12 can be inserted and in which an ejector 34 for the insertion tongue 12 is movably mounted (FIGS. 8 and 9). In the base of the upper shell 14, there is also an opening 36 for the ejector 34, the opening extending parallel to the lengthwise axis of the closure. In line with the opening 36, closer to the front of the closure 10, there is a latch opening 38 through which the latch 18 can engage the insertion tongue 12. In the base of the lower shell 16, parallel to the lengthwise axis, there is an elongated slit 40 to receive an ejector spring 35. Approximately across from the latch opening 38, offset a bit towards the back end of the closure, there is a second latch opening 42 of about the same size in the base of the lower shell 16. In the area of the back end of the frame, hooks 44 are formed on the legs of the upper shell 14, and the hooks form bearings for the latch 18.

In this embodiment, the latch 18 is a stamped part made of sheet metal and it has a bearing section 46 as well as a T-shaped latch section 48, which are connected to each other by two parallel lengthwise webs 50. The T-shaped latch section 48 has a crosswise web 52 whose ends form two projections 54 and from the middle of whose bottom a foot 56 extends that can engage the insertion tongue 12 through the latch openings 38, 42 and through an opening 13 in order to latch the insertion tongue 12 in the closure 10. The lengthwise webs 50 extend to both sides of the foot 56, likewise from the bottom of the crosswise web 52, the ends of the lengthwise webs 50, which are connected to the crosswise web 52, being bent in such a way that the lengthwise webs and the foot 56 enclose an angle of slightly less than 90° (FIGS. 10 through 16). The opposite ends of the lengthwise webs 50 are bent at a right angle and become the bearing section 46. On each of the edges of the bearing section 46 facing the lengthwise sides of the closure 10, a recess 58 is provided that divides the appertaining end of the bearing section 46 into a bearing pin 60 and a holding pin 62. As can be seen in FIG. 2, the hooks 44 engage the legs of the upper shell 14 through the recesses 58, partially surrounding the bearing pin 60 so that the bearing section 46 of the latch 18 is mounted on the upper shell 14 so that it can pivot. In this manner, the holding pin 62 prevents the latch 18 from slipping out of the bearing, which is open towards the back.

FIG. 3 shows the blocking element 20 that consists of an essentially rectangular plate. In the middle of each of the narrow sides, a rotating pin 70 is formed with which the blocking element 20 is mounted so as to pivot around an axis A. For this purpose, bores 71 are provided in the middle of the legs of the upper shell 14 (FIGS. 2 and 5) which are engaged by the pins 70. The blocking element 20 is urged by a spring 22 into a blocking position (FIG. 1) in which it blocks the latch 18 in its locking position. Here, it lies against the stops 64 which are likewise formed on the legs of the upper shell 14. The lengthwise side of the blocking element 20, which faces the frame when it is in the blocking position, forms a contact surface 72 with which the latch 18 lies against the lengthwise webs 50 of the latch 18 when it is in the blocking position. On the narrow sides of the blocking element 20, there are carrier pins 74 in the form of projections that extend parallel to the rotating pins 70, namely, from the end of the narrow sides that is closest to the contact surface 72. The carrier pins 74 are shorter than the rotating pins 70, so that they do not touch the legs of the upper shell 14. By means of bores 76, the blocking element 20 is counterbalanced in such a way that its center of gravity lies on the rotational axis $A_B$ of the rotating pins 70.

The ejector 34 consists of an essentially rectangular plate that is so thick that the ejector 34 can smoothly be moved between the upper shell 14 and the lower shell 16. In so doing, the ejector 34 is guided by the base 25 of the upper shell 14, as well as by the base 27 and the legs 28 of the lower shell 16. On the upper side of the ejector 34 pointing to the upper shell 14 there is formed a rectangular projection 80 which projects through the opening 36 in the base of the upper shell 14. On the end of the ejector 34 facing the front end of the closure 10, a recess 84 with rounded corners is formed, which can receive the tip of the insertion tongue 12. On the opposite back end of the ejector 34, parallel to its lengthwise axis, a recess 86 having an approximately semicircular cross section extends crosswise to the lengthwise axis into which one end of the ejector spring 35 extends. As already described above, the ejector spring 35 is held in the lengthwise slit 40 and supported on the frame so that it presses the ejector 34 into an ejection position as shown in FIG. 9. On the top of the ejector 34, a sliding wall 88 is provided, which is parallel to the main plane of the ejector 34 that extends beyond the recess 84.

The release button 24 has an actuation surface 90 facing the front of the closure 10 as well as two parallel support walls 92 running perpendicular to the actuation surface 90 in the lengthwise direction of the closure 10. On the narrow side of each support wall 92, on the end opposite from the actuation surface 90, there is a carrier surface 94 that engages the carrier pin 74 of the blocking element 20 when the release button 24 is actuated. At a right angle to the carrier surface 94, there is a resting surface 96 against which the projections 54 of the latch 18 can lie when the latch is in the locking position. The resting surface 96. in turn, is followed by a ramp surface 98 that encloses an obtuse angle with the resting surface 96 and whose function becomes clear from the description of the unlatching procedure described below.

Below, the function of the closure 10 is explained with reference to an insertion procedure of the insertion tongue 12 and to the unlatching of the closure, which are shown in consecutive positions in FIGS. 10 through 15.

In the basic state, that is to say, when the tongue is not inserted (FIG. 10), the ejector 34 is in the ejection position. The latch 18 is in an opening position, its foot 56 lying against the sliding wall 88 of the ejector 34. The blocking element 20, as a result of being urged (arrow) by the spring 22 via the contact surface 72, exerts a moment on the latch 18.

When the tongue 12 is inserted, the tip of the insertion tongue engages the recess 84 (FIG. 11) and moves the ejector 34 out of its ejection position. When the ejector 34 is moved, the foot 56 of the latch 18 slides on the sliding wall 88. Since the sliding wall 88 protrudes beyond the recess 84 towards the edge of the opening in the insertion tongue, the latch 18 is prevented from sliding on the insertion tongue 12 and possibly leaving abrasion markings there. As soon as the tongue 12 is inserted so far that the opening 13 in the tongue 12 is positioned under the latch opening 38 in the frame, the foot 56 of the latch 18 can slip into the opening in the insertion tongue 12. Due to the torque exerted by the blocking element 20, the latch 18 is swiveled into its locking position (FIG. 12). In doing so, the blocking element 20 turns—in the figures in the counterclockwise direction—beyond a position that is perpendicular to the lengthwise webs 50 of the latch, until it is halted by stops 64 on the legs of the upper shell 14, as a result of which it has reached its blocking position.

In this blocking position, the ejector 34—as a result of being urged by the ejector spring 35 via the insertion tongue 12—exerts a force $F_S$ on the foot 56 of the latch 18 which, via the lever arm L (see FIG. 16), causes a torque on the latch 18 that strives to swivel the latch 18 out of its locking position. However, the blocking position is characterized in that a force F, which acts upon the blocking element 20 via the contact surface 72 when the latch 18 is swiveled out of the locking position, acts in the same direction as the torque exerted by the spring 22. Thus, the force F presses the blocking element 20 more strongly against the stops 64 so that the swiveling of the latch 18 is prevented. A blocking position of the blocking element 20 is thus reached when the line of application of the force F, which acts perpendicular to the lengthwise webs 50—as seen from the rotational axis As of the latch 18—passes behind the rotational axis $A_B$ of the blocking element 20 (FIG. 12).

This geometry leads to a reliable blocking of the latch 18, which can only be released by a torque applied from the outside onto the blocking element 20. Since the center of gravity of the blocking element 20, however, as described above, lies on its rotational axis $A_B$, the mass inertia of the blocking element 20 does not cause such a torque, even in the case of a strong acceleration of the closure 10, such as occurs, for example, when the seat belt tensioner is activated.

If the release button 24 is additionally secured against unintentional shifting caused by acceleration forces, then the described closure 10 is secured against unintentional opening in case of acceleration in any direction. An especially advantageous securing of the release button 24 is effectuated in a second embodiment of the invention, which is described below. For this purpose, however, a securing means known from the state of the art can be used.

In order to open the closure, as mentioned above, a torque has to act upon the blocking element which can overcome the moment of the spring 22. For this purpose, the release button 24, which is merely indicated in FIGS. 13 through 15, is shifted towards the left in the figures. Here, the carrier surface 94 engages the carrier pins 74 of the blocking element 20 and turns it out of its blocking position (FIG. 13). When the release button 24 is moved further, the ramp surface 98 engages the projections 54 of the latch 18 (FIG. 14) and swivels the latter out of its locking position, as a result of which the insertion tongue 12 is released and the ejector 34 ejects the insertion tongue due to the force of the ejector spring (FIG. 15).

When the geometry and the spring forces are appropriately dimensioned—as described below—it can be achieved that the closure 10 already opens in the position shown in FIG. 14 without the release button 24 having to be pushed in any further. As described above, the ejector spring exerts a force $F_S$ (FIG. 16) on the latch 18 at the contact edge B' with the foot 56 via the ejector 34 and the insertion tongue 12, thus causing a torque $F_s \times L$. This is countered by a torque $F_b \times K$, which is caused at the contact point B by the force $F_b$ brought about by the pressure on the blocking element 20. With such a corresponding dimensioning of the ejector spring 35 and of the blocking spring 22 as well as of the lever arms K and L, the torque $F_S \times L$ is the dominant one and the ejector 34 can swivel the latch 18 out of its locking position. Advantageously, due to the slanted position of the foot 56 (the angle between the foot 56 and the lengthwise webs 50 is a bit less than 90°), it is achieved that the foot 56 is aligned approximately tangentially to the arc that it traverses during the swiveling, so that its swiveling space is reduced. Moreover, the foot 56 only touches the edge of the opening in the insertion tongue on its lower edge B', as a result of which the length of the lever arm L is maximized.

Advantageously, it is nevertheless possible to provide a ramp surface 98 so that, in case of any increased friction between the blocking element 20 and the latch 18 resulting from dirt, a reliable unlatching of the closure 10 is ensured. In any case, however, the described arrangement causes the latch 18 to be subjected to a torque exerted by the ejector spring 35, which reduces the actuation force of the release button that is needed to open the closure, facilitating the operation of the closure.

As can be seen in the figures, the foot 56 of the latch 18 is freely movable in the latch openings 38 and 42, without touching the frame. Thus, the friction that occurs with other latch principles, for example, is eliminated with a moveably guided latch, as a result of which a more reliable functioning is ensured. Nevertheless, in order to be able to withstand extreme tensile stresses on the insertion tongue, the bearing of the latch 18 on the upper shell 14 can be deformed so that, in case of a crash, the entire latch 18 can be moved into the latch openings 38 and 42 towards to the front of the closure until it is halted by the stops formed by the edges 100 (see FIG. 14) of the latch openings. The deformable bearing is advantageously achieved by the design of the hooks 44 on the upper shell 14, which can be bent open plastically in this case.

FIGS. 17 through 28 show a second embodiment of the invention, reference numerals increased by 100 being used for already known components.

The mode of operation especially of the latch 118 and of the blocking element 120 is the same in terms of the function of the closure 110 as in the first embodiment, which is why a comprehensive description of the functioning has not been provided here. Therefore, the description below concentrates on the differences from the first embodiment.

The closure 110 shown in FIG. 17 has a one-piece frame 115, consisting of U-shaped sheet metal plate with a base 125, a right-hand leg 126, which can be seen in the background in the figures, and a left-hand leg 127. In the base 125 (FIG. 19), an ejector opening 136 is provided to receive an ejector 134 and an ejector spring 135. The ejector opening 136 consists of a narrower, front section **136*a* and a wider, back section 136*b*. Extending into the back section, there is a mandrel 117 on which one end of the ejector spring 135 is mounted (FIGS. 18 and 25**).

Like in the first embodiment, bearings in the form of hooks 144 have been shaped onto the back end of the legs 126 and 127. Approximately in the middle of each of the legs 126 and 127, bores 171 are provided in which a blocking element 118 is pivoted. Slits lead from each of the bores 171 to the edge of the legs 126 and 127 so that the support pins 170 of a blocking element 118 can be inserted into the bores 171 without having to bend the legs 126 and 127.

Furthermore, in each of the legs 126 and 127, bearing bores 119 are provided for pivoting a toggle lever 121 whose function will be described below. These bearing bores 119 are located near the front end of the frame 115 and are likewise connected by slits to the edge of the legs 126 and 127 in order to allow a simple assembly of the toggle lever 121.

Since the frame in this embodiment is made of one piece and therefore does not have a hollow space into which the tongue 12 could be inserted, on each of the inner sides of the legs 126 and 127, below the bearing bores 119, there is a projection 123 to guide the insertion tongue 12.

The ejector 134, which is shown in detail in FIG. 23, differs from the ejector 34 of the first embodiment essentially with respect to two characteristics: first of all, on the bottom facing its base 125, there is a guide piece 133 having a T-shaped cross section (FIG. 25). Thus, parallel grooves are formed between the bottom of the ejector 134 and the guide piece 133, and the edges of the front section **136*a* of the ejector opening engage the grooves, so that the ejector 134 is guided movably on the base 125. Secondly, a wedge-shaped stop projection 131 is formed onto the top of the ejector 134. With this stop projection 131, the ejector 134 can be supported on the latch 118 (FIG. 18) if the tongue is inserted too far into the frame 115 because, for example, the entire closure 110** is abruptly braked after a seat belt tensioner has been activated. For this purpose, on the latch 118, a stop 137 is provided which starts at the bearing section 146 and extends between the two lengthwise webs 150 and is bent in the same direction as the foot 156.

The blocking element 120 (FIG. 22), like the blocking element 20 of the first embodiment, consists of a rectangular plate with a contact surface 172 and two rotating pins 170. The rotating pins 170 have a rectangular cross section and have rounded-off edges. As a result, in a certain angle position of the blocking element 120, they can be inserted through the slits into the bores 171 in a simple manner. As a prolongation of the contact surface 172, there are carrier pins 174 that extend beyond the legs 126, 127 (FIG. 25). One of the rotating pins 170 is elongated and bent at its free end. It holds the spring 122 that presses the blocking element 120 into its blocking position, one end of the spring 122 engaging the adjacent carrier pins 174 and the other end engages the right-hand leg 126. From the contact surface 172, a recess 176 extends to the middle of the blocking element 120, whose size determines the mass distribution of the blocking element in such a way that the center of gravity of the blocking element 120 lies on its rotational axis $A_B$.

The release button 124 is shown in detail in FIG. 20. There is an actuation surface 190 on the front of the release button 124 facing away from the frame 115. From the back of the release button 124, two support walls 192 extend parallel to the legs 126, 127. On the free ends of the support walls 192, projections 193 are provided which engage the legs 126 and 127 through the elongated slits 195 (FIG. 17) in order to guide the support walls to the legs 126 and 127. On the outer sides of the support walls 192, there are stiffening ribs 197 that stabilize the support walls 192. These stiffening ribs 197 run from the free end to about the middle of the support walls 192 along their upper edge. In one partial segment, the stiffening ribs 197 form carrier surfaces 194 running approximately perpendicular to the actuation surface 190, and these carrier surfaces 194 can engage the carrier pins 174 of the blocking element 120 in order to swivel the blocking element 120 out of its blocking position when the release button 124 is actuated. Over their further course, the stiffening ribs 197 form a U-shaped recess 199 which is engaged by the toggle lever 121 and whose function is described in detail below.

Likewise in the middle of the back of the release button, a guide wall 201 extending parallel to the base 125 serves to guide the tongue 12 when it is inserted. Between the guide wall 201 and the support walls 192, guide webs 202 run parallel to the latter, and, in the assembled state, one guide web 202 and one support wall 192 each surrounding one of the legs 126 and 127. Here, the guide webs 202 are located inside the "U" formed by the frame 115. The upper narrow sides of the guide webs 202 form guide surfaces with which the release button 124 is guided to fingers 203 which project from the front ends of the legs 126, 127 into the inside of the frame 115. The free ends of the guide webs 202 taper in a wedge shape towards the base 125 so that ramp surfaces 198 are formed on its narrow sides with which the release button can swivel the latch 118 via the projections 154 out of its locking position, as already described in conjunction with the first embodiment.

The closure 110 also has a toggle lever 121, which is shown separately in FIG. 21. The toggle lever 121 consists of two parallel side parts 205 and 207 which are each connected at one end to each other by an inertial mass 209. The side parts 205, 207 each have an outer surface and an inner surface, each of the inside surfaces facing the other side part.

In the middle of the inside of each side part 205, 207, a cylindrical rotating pin 211 is provided with which the toggle lever 121 is mounted in the bearing bores 119 so as to pivot around the axis $A_k$. The cylindrical shape of the rotating pins 211 is flattened by two parallel side surfaces so that the rotating pins 211 can be inserted through the slits into the bearing bores 119. In the middle, the free ends of the side parts 205 and 207 are bent at a right angle towards the outside. On the inner surfaces of the free ends, cylindrical carriers 213 are formed that are additionally supported by stiffening ribs 215 on the inner surfaces. The carriers 213 engage the recesses 199 formed by the stiffening ribs 197 so that the toggle lever 121 is swiveled when the release button 124 is moved and vice versa (FIGS. 27 and 28).

On the outer surface of the one side part 207, on the end that is connected with the inertial mass 209, there is a holding pin 217 for a restoring spring 219 whose other end is hooked in a hook 221 on the left-hand leg 127 of the frame 115 (FIGS. 17 and 27). The restoring spring 219 is tensioned via the toggle lever 121 when the release button 124 is pressed. Thus, the release button 124 is subject to a restoring force that moves it back into its starting position after it has been released.

Another important function of the toggle lever 121 is to secure the release button 124 against unintentional shifting due to acceleration forces. For this purpose, the toggle lever is designed in such a way that its center of gravity $S_k$ does not lie on the rotational axis $A_k$. In FIG. 28, the forces and the lever arms on the toggle lever 121 are schematically shown upon acceleration $a_v$ in the lengthwise direction of the closure 110. Due to the mass inertia, an inertial force $F_k$ is exerted on the center of gravity $S_k$ of the toggle lever 121, which inertial force brings about a torque $F_k \times L_{k1}$ via the lever arm $L_{k1}$. However, due to its mass inertia, the release button 124 likewise exerts a force $F_L$ on the toggle lever 121, namely, via the projections 195 which engage the recesses 199. This force $F_L$ leads to a torque $F_L \times L_{k2}$ that counteracts the torque $F_k \times L_{k1}$. According to the invention, the lever arms $L_{k1}$ and $L_{k2}$ and the mass of the toggle lever 121 are selected in such a way that the torques cancel each other out. In this manner, the release button 124 is safeguarded against unintentional shifting and thus the closure 110 is reliably secured against unintentional opening during acceleration.

What is claimed is:

1. A closure for a seat belt, comprising a release button shiftably mounted on a frame and cooperating with a latch which can be swiveled between a locking position and an opening position around a swiveling axis, and a blocking element that assumes a blocking position in which said blocking element blocks said latch in said locking position, said blocking element being mounted on said frame so as to pivot around a pivoting axis that passes through a center of gravity of said blocking element, said release button causing said blocking element to pivot out of said blocking position into a release position, said blocking element, when in said blocking position, being exposed to a force from said latch, said force from said latch keeping said blocking element in said blocking position.

2. The closure according to claim 1, wherein said pivoting axis of said blocking element is arranged between said swiveling axis of said latch and an application line of said force from said latch.

3. The closure according to claim 1, wherein a stop is provided, said blocking element, when in said blocking position, being pressed against said stop by said force from said latch.

4. The closure according to claim 1, wherein on said release button a ramp surface is provided that can engage a projection on said latch to cause said latch to swivel out of said locking position and into said opening position.

5. The closure according to claim 1, wherein on said release button a carrier surface is provided that can engage a projection on said blocking element to cause said blocking element to pivot out of said blocking position and into said release position.

6. The closure according to claim 1, wherein an ejector for an insertion tongue is provided that is acted upon by an ejector spring, said latch being swiveled from said locking position into said opening position when said insertion tongue is ejected.

7. The closure according to claim 1, wherein said blocking element is urged by a spring into said blocking position.

8. The closure according to claim 1, wherein said latch is elastically mounted to that it can be shifted radially with respect to said swiveling axis until a stop is reached.

9. The closure according to claim 1, wherein a toggle lever is provided that counteracts a shifting of said release button upon acceleration of said closure.

* * * * *